United States Patent [19]

Enters et al.

[11] 4,203,237

[45] May 20, 1980

[54] SNOWBLOWER

[75] Inventors: Edward W. Enters, Fredonia; Weldon R. Kuhn, Plymouth, both of Wis.

[73] Assignee: Gilson Brothers Company, Plymouth, Wis.

[21] Appl. No.: 915,663

[22] Filed: Jun. 15, 1978

[51] Int. Cl.[2] ..... E01H 5/00

[52] U.S. Cl. ..... 37/43 E; 198/677; 198/659

[58] Field of Search ..... 37/43 R, 43 D, 43 E, 37/53; 198/659, 676, 677

[56] References Cited

U.S. PATENT DOCUMENTS

| | | | |
|---|---|---|---|
| 355,124 | 12/1886 | Birkholz | 198/677 X |
| 459,113 | 9/1891 | Rymal | 198/677 X |
| 701,969 | 6/1902 | Van Arsdell | 198/677 X |
| 1,371,116 | 3/1921 | Quelms | 198/677 X |
| 2,397,305 | 3/1946 | Wheat | 198/676 |
| 2,741,042 | 4/1956 | Brown | 37/43 D |
| 3,021,661 | 2/1962 | Couberly | 37/43 D |
| 3,363,345 | 1/1968 | Ober | 37/43 D |
| 3,452,460 | 1/1969 | Cope et al. | 37/43 D |
| 3,484,963 | 12/1969 | Heth et al. | 37/53 X |
| 3,548,522 | 12/1970 | Roper | 37/43 R |
| 3,603,008 | 9/1971 | Heth | 37/43 E |
| 3,762,537 | 10/1973 | Lutz | 198/676 X |
| 3,805,421 | 4/1974 | Kamlukin et al. | 37/43 D |

*Primary Examiner*—E. H. Eickholt

*Attorney, Agent, or Firm*—Michael, Best & Friedrich

[57] ABSTRACT

A snowblower includes an auger having a generally horizontal auger cylinder and at least a pair of spaced apart planar elastomeric auger flights surrounding the auger cylinder. The auger flights extend outwardly from the surface of the auger cylinder and from opposite ends of the cylinder toward each other. The auger also includes an impeller blade extending radially from the auger cylinder surface and having opposite ends, one of the impeller blade ends being connected to one of the auger flights and the other of the impeller blade ends being connected to the other of the auger flights. The auger further includes an auger frame rotatable about a longitudinal axis, and the auger frame includes two frame halves secured together at a parting plane including the longitudinal axis.

22 Claims, 4 Drawing Figures

SNOWBLOWER

BACKGROUND OF THE INVENTION

The present invention relates to powered snow removal machines, and more specifically to snowblowers having power driven rotatable augers functional to throw snow out of the path of the snowblower.

Snowblowers of the type commonly used by homeowners for removing snow from sidewalks and driveways frequently include an auger or paddles for propelling snow through a discharge chute. The auger or paddles are generally comprised of metal or hard plastic, and during operation of the snowblower on a driveway or sidewalk, the auger or paddles may strike the surface of the driveway or sidewalk resulting in possible damage to that surface and to the machine.

U.S. Pat. No. 3,359,661, issued Dec. 26, 1967 to Speiser et al discloses a powered snowblower having a plurality of radially disposed planar paddles for propelling snow through a discharge chute.

U.S. patent application Ser. No. 764,823, filed Feb. 2, 1977 by Enters et al and assigned to the assignee of the present invention illustrates a snowblower having an auger with generally helical metal blades spaced radially outwardly from a rotatably driven auger shaft.

U.S. Pat. No. 3,512,279, issued May 19, 1970 to Benson and U.S. Pat. No. 3,078,603, issued Feb. 26, 1963 to Ertsgaard et al, also illustrate snowblowers having a helical auger blade driven by an auger shaft, the helical auger blade being spaced radially outwardly from the auger shaft.

Other alternative snowblower constructions are shown in the following patents:

U.S. Pat. Nos. 2,714,772—Erickson—8/9/55
U.S. Pat. Nos. 2,919,504—Rubin—1/5/60
U.S. Pat. Nos. 3,074,189—Phelps—1/22/63
U.S. Pat. Nos. 3,045,369—Howe—7/24/62
U.S. Pat. Nos. 3,021,620—Rosenthal—2/20/62

SUMMARY OF THE INVENTION

This invention is concerned with a power snowblower including a rotatable auger which provides a resilient material for engaging the surface being cleaned and an auger construction which is readily manufactured.

The snowblower of the invention includes an auger having an auger frame rotatable about a longitudinal axis, the auger frame including two halves secured together and joined at a parting plane including the longitudinal axis.

One of the features of the invention is the provision of the auger frame including an auger cylinder and the auger further including a pair of auger flights supported on opposite ends of the auger cylinder and an impeller blade extending radially outwardly from the auger cylinder and having opposite ends connected to respective ones of the auger flights.

Another of the features of the invention is the provision of the auger flights being planar and elastomeric and the impeller blades having elastomeric radially outer edges.

Another of the features of the invention is the provision of the frame halves each including an elongated semi-cylindrical member, the semi-cylindrical members being joined together in facing parallel relation to form the auger cylinder and the impeller blade being integral with and extending from one of the edges of the semi-cylindrical members.

One of the advantages of the invention is that the elastomeric auger flights and edges of the impeller blades may contact the surface being plowed and tend to clean the surface better than a metal auger blade. The elastomeric blade portions also have a cushioning effect, preventing shock to the machine in the event the auger contacts the surface, and have a self-propelling effect when the auger contacts the surface thereby making the snowblower easier to push. A further advantage of the invention is that the auger is constructed from components which can be readily manufactured and which are particularly adapted to facilitate assembly. Furthermore, the auger is readily disassembled and the elastomeric sections of the auger can be easily replaced if they become worn. An additional advantage of the invention is that the construction of the auger causes snow to be moved from the opposite ends of the auger housing centrally thereof so that the snow is concentrated at the center of the housing and can be efficiently discharged by the impeller blades of the auger.

Other features and advantages of the invention will be pointed out in, or become apparent from, the specification, drawings and claims, as will modifications of the embodiment of the invention shown in the drawings.

DESCRIPTION OF THE PREFERRED EMBODIMENT

Figure 1:
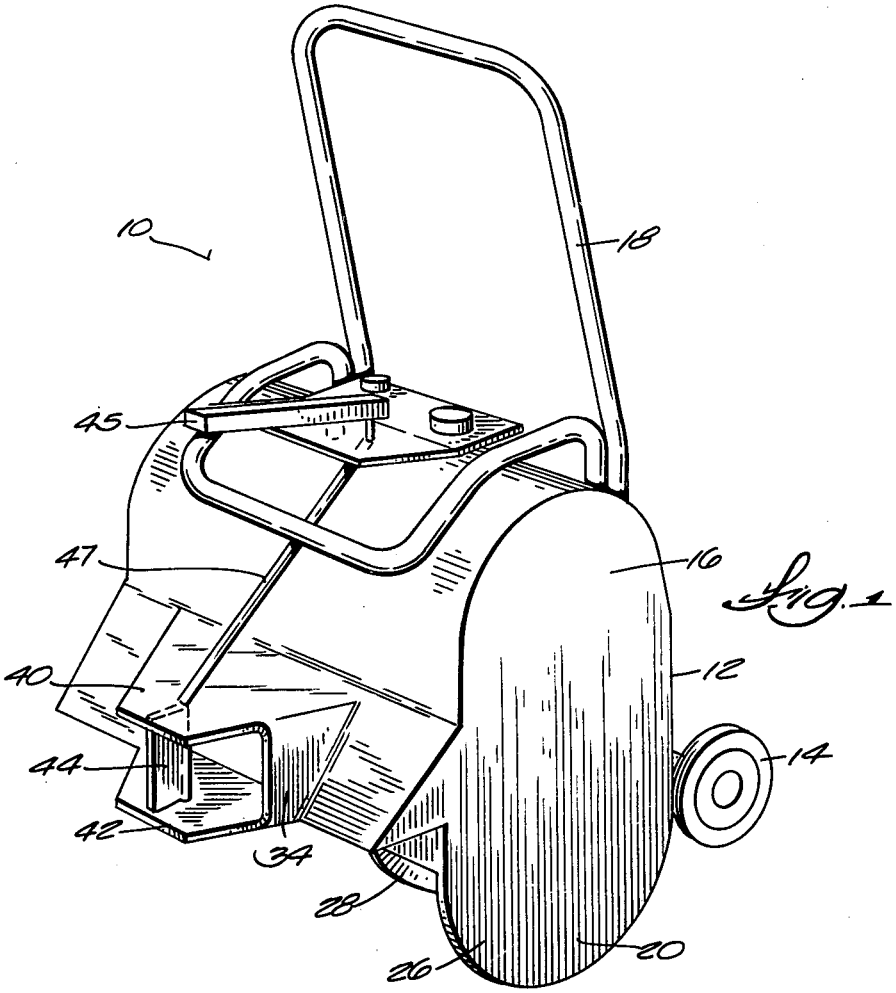
FIG. 1 is a perspective view of a snowblower embodying the present invention.

The snowblower 10 illustrated in FIG. 1 includes a frame 12 supported for movement along the ground by a pair of wheels 14 (one shown). The frame 12 supports a prime mover which can be, in one preferred embodiment, an internal combustion engine. The snowblower 10 also includes a shroud 16 covering the engine and a guiding handle 18 connected at its lower end to the frame 12.

The snowblower 10 also includes a rotor housing 20 supported by the frame 12 forwardly of the wheels 14. The rotor housing 20 includes a top wall 22, a pair of spaced apart generally vertical opposed side walls 24 and 26, which rotatably support the opposite ends of a rotatable collector or auger 28. The rotor housing 20 further includes a concavely curved substantially semi-circular back wall 30 extending between the side walls 24 and 26 and being integrally connected at its upper edge with the top wall 22. The top wall 22 includes a centrally disposed opening 32 therethrough and supports a discharge chute 34 extending upwardly from the top wall 22. The lower forwardly extending leading portion of the back wall 30 terminates in an edge or skid portion such that the back wall 30 serves as a circularly shaped scoop which collects the snow, and the rotatable auger 28 functions to move the snow collected in the auger housing centrally and to impel the snow upwardly through the discharge chute 34.

The snowblower engine is drivingly connected to the rotatable auger 28 for rotatably driving the auger 28 by a driving belt 36 driving a pulley 38 journaled to one end of the rotatable auger 28.

The discharge chute 34 of the auger housing 20 further includes a pair of planar opposed parallel walls 40 and 42, the wall 40 being integral with and extending from the upper edge of the back wall 30. The other discharge chute wall 42 is placed from and parallel to the wall 40 and is integrally connected to the top wall 22 of the rotor housing 20. The walls 40 and 42 are joined by a transverse directional vane 44 therebetween, the directional vane 44 being pivotally supported at its opposite ends by the walls 40 and 42 for pivotal movement about an axis generally perpendicular to the parallel walls 40 and 42. Pivotal movement of the directional vane 44 is functional to control the direction the snow is thrown as it is discharged through chute 34. The position of the vane 44 is controlled by a lever 45 supported by the shroud 16 and a connecting linkage 47 connected to the vane 44 to cause pivotal movement of the directional vane 44 in response to pivotal movement of the lever 45.

In a preferred embodiment of the invention, the auger 28 is comprised of an auger cylinder 46 supporting two pairs of spaced apart elastomeric, planar auger flights 48, 50, 52 and 54, one pair of auger flights 48 and 50 being secured to one end of the auger cylinder 46 and the other pair of auger flights 52 and 54 being secured to the other end of the auger cylinder 46 and having a direction of wrap opposite the direction of wrap of the other pair of the auger flights. The pairs of auger flights are longitudinally spaced apart, and the auger 28 further includes a pair of radially extending planar impeller blades 56 and 58 attached to the auger cylinder 46 intermediate its opposite ends and extending radially outwardly from the surface of the auger cylinder 46. In the preferred embodiment, the impeller blades 56 and 58 are mutually coplanar and define a plane including the longitudinal axis of the auger cylinder 46. The impeller blades also include an elastomeric resilient member along their respective radially outer edges. The impeller blades 56 and 58 are disposed on opposite sides of the auger cylinder 46 and are connected between respective pairs of the auger flights, the impeller blade 56 being connected at its respective opposite ends to the auger flights 50 and 52, and the impeller blade 58 being connected at its respective ends to the auger flights 48 and 54. In operation, the auger flights 48 and 50 at one end of the auger cylinder 46 and the auger flights 52 and 54 at the other end of the auger cylinder 46 force the snow received in the housing 20 centrally toward the impeller blades 56 and 58, and the impeller blades 56 and 58 impel the snow upwardly through the discharge chute 34.

Figures 3, 4:
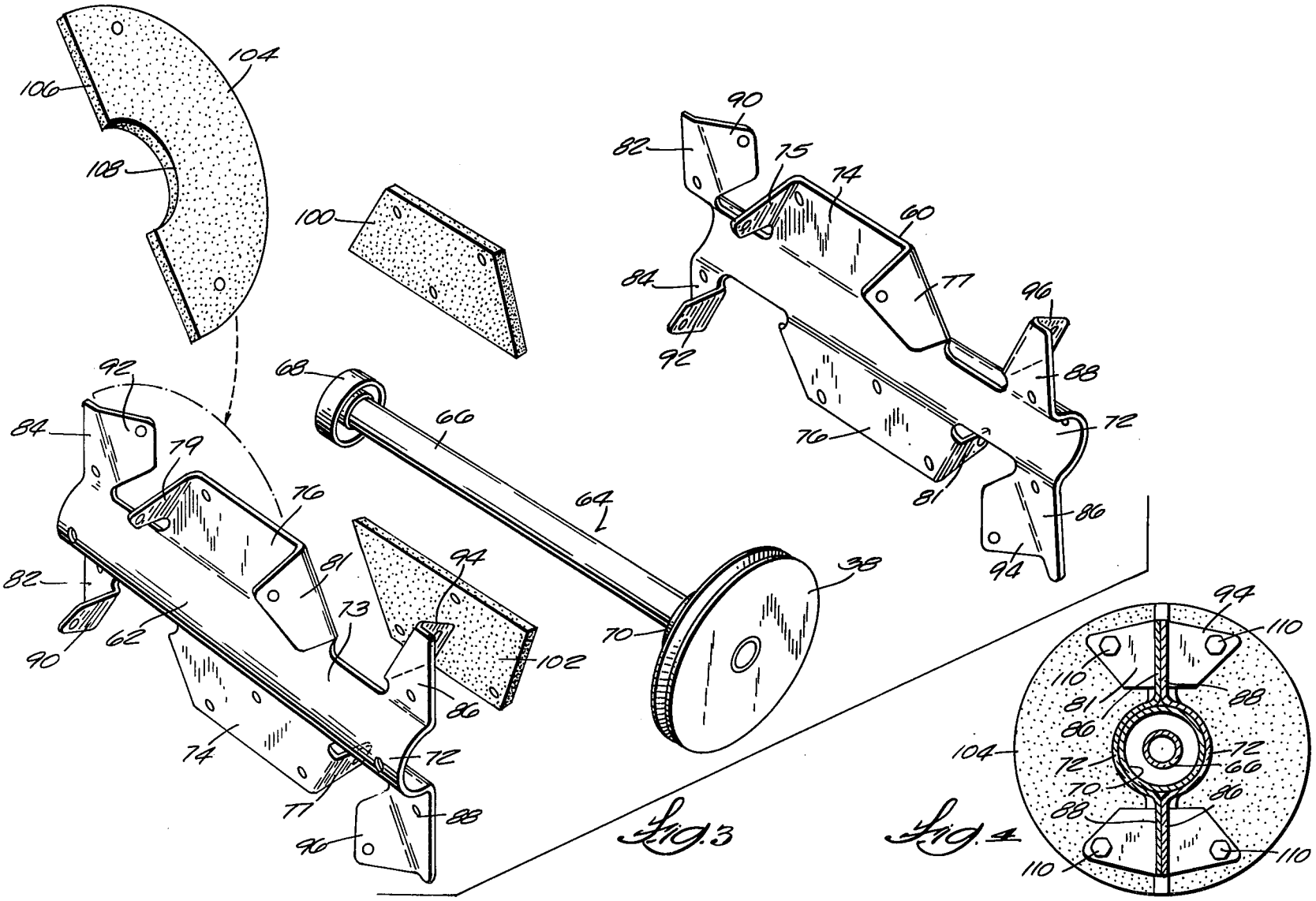
FIG. 3 is an exploded perspective view of the auger shown in FIG. 2.
FIG. 4 is a cross-section view taken along line 4—4 in FIG. 2.

In one preferred embodiment of the invention, the rotatable auger 28 is comprised of an auger frame having a pair of mating frame members 60 and 62, shown in FIG. 3 and which are rotatable about the axis of rotation of the auger, and the frame members 60 and 62 when joined together define a parting plane therebetween, and the axis of rotation of the auger lies in that parting plane. The frame members 60 and 62 are formed from malleable sheet metal in the preferred embodiment of the invention but could also be formed from plastic, fiberglass, or the like. The frame members 60 and 62 are held together in adjacent mating relation, having an auger drive shaft assembly 64 secured therebetween as shown in an exploded view in FIG. 3. The auger drive shaft assembly 64 includes a central cylindrical shaft 66 supporting circular auger support hubs 68 and 70, respectively, on its opposite ends. The end of the shaft 66, supporting hub 70, also supports the drive pulley 38.

Figure 2:
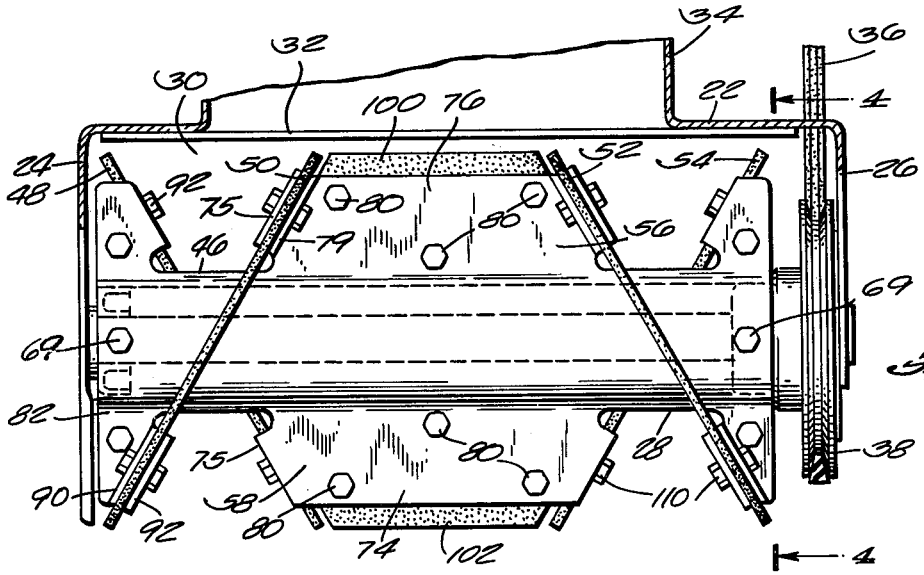
FIG. 2 is an enlarged side elevation view of the auger of the snowblower shown in FIG. 1.

The auger frame members 60 and 62 each include a central longitudinally extending semi-cylindrical section 72. When the frame members 60 and 62 are secured together in facing relation, the outer concave semi-cylindrical surfaces 73 of the trough sections 72 form the auger cylinder 46 and the support hubs 68 and 70 are clamped between the frame members 60 and 62. The support hubs 68 and 70 are further secured between the frame members 60 and 62 by bolts 69 (FIG. 2).

The impeller blades 56 and 58 of the auger 28 are defined in part by central coplanar impeller flanges 74 and 76 extending radially outwardly from the respective longitudinal edges of the trough sections 72 of the frame members 60 and 62. The impeller flanges 74 of each of the frame members 60 and 62 include opposite sloped ends which define an acute angle with respect to the axis of rotation of the auger 28 and are mutually converging. The sloped ends of the impeller blade section 74 support respective planar auger flight supporting flanges 75 and 77, the flanges 75 and 77 being generally perpendicular to the plane of blade section 74 and extending in the direction of intended rotation of the auger 28 and defining an acute angle with respect to the longitudinal axis of the auger 28. The impeller flanges 76 of each of the frame members 60 and 62 have a structure similar to the flanges 74 and also include opposite sloped ends which each define an acute angle with respect to the axis of rotation of the auger and which are mutually converging. The sloped ends of the impeller flanges 76 support auger flight supporting flanges 79 and 81 each being generally perpendicular to the plane of the impeller flanges 76 and extending in the direction of intended rotation of the auger 28. The frame members 60 and 62 also each include coplanar flanges 82, 84, 86 and 88. The flanges 82 and 84 are integrally attached to one end of the trough section 72 in longitudinally spaced relation from the blade sections 74 and 76, respectively, and extend radially outwardly from respective longitudinal edges of the trough section 72 and in opposite directions. The flange 82 includes a sloped edge supporting a planar auger flight supporting flange portion 90. The auger flight supporting flange portion 90 extends generally perpendicularly to the plane of the flange 82 and in a direction opposite that of the intended rotation of the auger 28, and the flange portion 90 defines a plane disposed at an acute angle with respect to the longitudinal axis of the auger. The flange 84 similarly includes a sloped edge supporting a planar auger flight supporting flange portion 92. The flanges 86 and 88 are integrally attached to the opposite end of the trough section 72 and extend radially outwardly from the respective longitudinal edges of the trough section 72 and in opposite directions. The flanges 86 and 88 also support similar auger flight supporting flange portions 94 and 96, respectively.

When the auger plates 60 and 62 are secured together, the impeller flange 74 of auger plate 60 and impeller flange 76 of auger plate 62 are positioned in closely adjacent parallel relation and retain a planar resilient blade 100 therebetween in sandwiched relation to form the impeller blade 56. Three bolts 80 extend through the impeller flange 72, resilient blade 100 and impeller blade 76 to clamp impeller flanges 74 and 76 against opposite planar surfaces of resilient blade 100. The impeller flange 76 of auger blade 60 and the impeller flange 74 of auger plate 62 similarly clamp the resilient blade 102 therebetween to form impeller blade 58 and are held together by bolts 80. As shown in FIG. 2, the resilient blades 100 and 102 each include an edge portion which extends radially outwardly with respect to the auger cylinder 46 beyond the edges of the impeller flanges 74 and 76.

The auger flight 48, shown in FIG. 3, comprises a planar semi-circular resilient blade having a semi-circular outer periphery 104 and having a linear edge 106. The auger flight 48 also includes a semi-circular notch 108 centrally located in its linear edge 106. By way of explanation, as viewed from the end of the auger (FIG. 4) the flights are generally semi-circular, i.e., both periphery 104 and notch 108 but in a flat plane they are both elliptical. Thus, reference to the flights being semi-circular is made in that context. The auger flight 48 is supported by the frame member 60 with the arcuate surface of the semi-circular notch 108 positioned against the convex outer surface 73 of one end of the semi-cylindrical trough section 72 of frame member 60. In one embodiment of the invention, the auger flight 48 can be advantageously positioned at an acute angle which may be approximately 60° with respect to the longitudinal axis of the auger 28. One of the opposite ends of the auger flight 48 is clamped in sandwiched relation between the flange portion 90 of flange 82 and flange portion 92 of flange 84 of the frame members and is secured by a bolt 110. The opposite end of the auger flight 48 is clamped between the flange portion 75 of impeller flange 74 of frame member 62 and flange portion 79 of impeller flange 76 of frame member 62. As shown in FIG. 2, when the frame members 60 and 62 are secured together in the manner described, the flange portions 92 of flange 84 and flange portion 75 of impeller flange 74 are coplanar and positioned against one planar surface of the flight 48, and flange portion 90 of flange 84 and flange portion 79 of flange 76 are coplanar and positioned against the opposite planar surface of the auger flight 48.

The auger flight 50 shown in FIG. 2 has a construction like that of the auger flight 48 and is supported on the opposite side of the auger 28 and is supported at an acute angle with respect to longitudinal axis of auger 28 and at an acute angle with respect to plane of auger flight 50. One end of auger flight 50 is clampingly engaged between a flange portion 75 of impeller flange 74 of frame member 60 and flange portion 79 of impeller flange 76 of frame member 62. The opposite end of the auger flight 50 is clampingly engaged between the flange portion 90 of flange 82 of frame member 62 and flange portion 92 of flange 84 of frame member 60.

The auger flights 52 and 54 are supported by the opposite end of the auger 28 in clamped relation between flange portions of the frame members 60 and 62 in the same manner as auger flights 48 and 50.

In a preferred form of the invention, the auger flights 48, 50, 52 and 54 and the resilient blades 100 and 102 are comprised of a resilient or elastomeric material such as rubber or flexible plastic. If during the operation of the snowblower, the auger flights and resilient blades become worn, the frame members 60 and 62 can be separated by removing bolts 69 and 80 and the auger flights and resilient blades can be replaced.

We claim:

1. A snowblower comprising, a forwardly opening auger housing defining an auger chamber having opposite side walls, and a discharge opening in an upper portion thereof, a wheel for supporting said housing for movement on the ground, a prime mover supported by said housing, and a rotatable auger rotatably drivingly connected to said primer mover, said rotatable auger including an auger cylinder having opposite ends and being rotatably supported in said auger housing for rotation about an axis, said auger being comprised of a pair of opposed stamped metal plates secured together and including opposed facing semi-cylindrical halves defining said auger cylinder, at least a pair of spaced apart auger flights, one of said auger flights supported by one of said ends of said cylinder and the other auger flight supported by the other of said ends of said cylinder, means for releasably securing said auger flights to said auger cylinder, and a radially extending impeller blade removably secured to said auger cylinder for rotation therewith for propelling snow through said discharge opening, said impeller blade having opposite ends, one of said impeller blade ends adjacent one of said auger flights and the other of said impeller blade ends adjacent the other of said auger flights.

2. The snowblower as set forth in claim 1 wherein said auger flights each have a planar semi-circular configuration and define an acute angle with respect to said axis.

3. The snowblower as set forth in claim 1 wherein said auger flights are comprised of elastomeric material and wherein said impeller blade has a radially outer edge comprised of elastomeric material.

4. The snowblower as set forth in claim 1 wherein said auger cylinder has an outer surface and wherein said impeller blades and said auger flights extend radially outwardly from said outer surface.

5. The snowblower as set forth in claim 1 and further including a second pair of auger flights secured to said auger cylinder for rotation therewith and extending from adjacent said side walls toward each other, one of said auger flights of said second pair being supported by one of said opposite ends of said auger cylinder and the other of said auger flights of said second pair being supported by the other of said opposite ends of said auger cylinder, means for releasably clamping said second pair of auger flights to said auger cylinder, and a second impeller blade secured to said auger cylinder between said second pair of auger flights and having opposite ends, one of said opposite ends of said second impeller blade being connected to one of said second pair of auger flights and the other of said opposite ends of said second impeller blade being connected to the other of said second pair of auger flights.

6. The snowblower as set forth in claim 1 wherein said auger is comprised of two frame halves secured together and joined at a parting plane including said longitudinal axis, said two frame halves defining a pair of semi-cylindrical members joined together in opposed facing parallel relationship to form a hollow cylinder, said semi-cylindrical members each having opposite ends and longitudinal edges, and wherein said means for releasably clamping said auger flights to said auger cylinder includes a first flange supported by one of said frame halves and outwardly of said hollow cylinder and a second flange supported by the other of said frame halves and opposed to said first flange, said first and second flange clampingly engaging an end of one of said auger flights therebetween.

7. An auger for a snowblower, the auger comprising an auger frame having opposite ends and being rotatable about a longitudinal axis, said auger frame including two frame halves secured together and joined at a parting plane including said longitudinal axis, said frame halves each being comprised of a stamped metal plate, the metal plates each including a semi-cylindrical portion, said frames halves being secured together such that said semi-cylindrical portions form an auger cylinder, and a pair of auger flights supported by said auger frame, one of said auger flights supported by one end of said auger frame and the other of said pair of auger flights supported by the other end of said auger frame, said auger frame halves including means for clampingly engaging said auger flights for removably securing said auger flights to be said auger frame.

8. The auger set forth in claim 7 wherein said auger flights are elastomeric and have a semi-circular outer periphery and wherein said auger flights are planar and define an acute angle with said longitudinal axis.

9. The auger set forth in claim 7 and further including at least one resilient generally planar impeller blade between said auger flights and extending radially with respect to said longitudinal axis, and wherein said two frame halves further include means for clampingly engaging said impeller blade and for removably securing said impeller blade to said auger frame.

10. The auger set forth in claim 7 wherein said auger frame includes a central cylindrical portion having opposite ends, at least one planar impeller flange extending radially outwardly from said central cylindrical portion and intermediate said opposite ends, and wherein said means for clampingly engaging said auger flights includes a first auger flight supporting flange extending radially outwardly from one of said opposite ends of said cylindrical portion and a second auger flight supporting flange supported by said planar impeller flange, said second flange extending transversely to said impeller flange and defining an acute angle with said longitudinal axis.

11. The auger set forth in claim 10 further including an elastomeric member secured to said planar impeller flange and at least a portion of said elastomeric member extending radially outwardly from said impeller flange.

12. An auger for use in a snowblower and comprising an auger body rotatable about a longitudinal axis and including a horizontal auger cylinder having opposite ends and a cylindrical surface, said auger body being comprised of a pair of opposed facing auger halves secured together, said auger halves being comprised of stamped metal plates, at least a pair of spaced apart auger flights, one of said auger flights supported by one of said ends of said auger cylinder and the other of said auger flights supported by the other of said ends of said cylinder, means for removably clamping said auger flights to said auger cylinder, and an impeller blade removably secured to said auger body for rotation therewith and extending radially from said cylindrical surface, said impeller blade having opposite ends, one of said blade ends being adjacent one of said auger flights and the other of said blade ends being adjacent the other of said auger flights.

13. The auger as set forth in claim 12 wherein said auger flights have a planar semi-circular configuration and are comprised of elastomeric material, and wherein said impeller blade has a radially outer edge comprised of elastomeric material.

14. The auger as set forth in claim 12 wherein said auger cylinder includes a pair of semi-cylindrical members joined together in facing parallel relationship to form said auger cylinder, said semi-cylindrical members each having opposite ends and longitudinal edges, and a pair of opposed radially outwardly extending impeller flanges extending from said longitudinal edges, said impeller blade being removably clampingly engaged between said impeller flanges.

15. The auger set forth in claim 14 and wherein said means for removably clamping said auger flights to said auger cylinder includes at least one end flange extending from said one longitudinal edge adjacent one of said opposite ends and wherein said auger flights each have opposite ends, one of said flight ends of one of said auger flights supported by said end flange and the other of said flight ends of said one auger flight supported by said impeller flange.

16. The snowblower set forth in claim 15 and wherein said auger flights are comprised of elastomeric material and wherein said planar blade has a radially outer edge comprised of elastomeric material.

17. A snowblower comprising, a forwardly opening auger housing defining an auger chamber having opposite side walls, and a discharge opening in an upper portion thereof, a wheel for supporting said housing for movement on the ground, a prime mover supported by said housing, and a rotatable auger rotatably drivingly connected to said prime mover, said rotatable auger including an auger cylinder having opposite ends and rotatably supported in said auger housing for rotation about an axis, at least a pair of spaced apart auger flights, one of said auger flights supported by one of said ends of said cylinder and the other auger flight supported by the other of said ends of said cylinder, means for releasably securing said auger flights to said auger cylinder, and a radially extending impeller blade removably secured to said auger cylinder for rotation therewith for propelling snow through said discharge opening, said impeller blade having opposite ends, one of said impeller blade ends adjacent one of said auger flights, and the other of said impeller blade ends adjacent the other of said auger flights, and a second pair of auger flights secured to said auger cylinder for rotation therewith and extending from adjacent said side walls toward each other, one of said auger flights of said second pair being supported by one of said opposite ends of said auger cylinder and the other of said auger flights of said second pair being supported by the other of said opposite ends of said auger cylinder, means for releasably clamping said second pair of auger flights to said auger cylinder, and a second impeller blade secured to said auger cylinder between said second pair of auger flights and having opposite ends, one of said opposite ends of said second impeller blade being connected to one of said second pair of auger flights and the other of said opposite ends of said second impeller blade being connected to the other of said second pair of auger flights.

18. A snowblower comprising, a forwardly opening auger housing defining an auger chamber having opposite side walls, and a discharge opening in an upper portion thereof, a wheel for supporting said housing for movement on the ground, a prime mover supported by said housing, and a rotatable auger rotatably drivingly connected to said primer mover, said rotatable auger including an auger cylinder having opposite ends and rotatably supported in said auger housing for rotation about an axis, at least a pair of spaced apart auger flights, one of said auger flights being supported by one of said ends of said cylinder and the other auger flight supported by the other of said ends of said cylinder, means for releasably securing said auger flights to said auger cylinder, and a radially extending impeller blade removably secured to said auger cylinder for rotation therewith for propelling snow through said discharge opening, said impeller blade having opposite ends, one of said impeller blade ends adjacent one of said auger flights and the other of said impeller blade ends adjacent the other of said auger flights, said auger being comprised of two frame halves secured together and joined at a parting plane including said longitudinal axis, said two frame halves defining a pair of semi-cylindrical members joined together in opposed facing parallel relationship to form a hollow cylinder, said semi-cylindrical members each having opposite ends and longitudinal edges, and wherein said means for releasably clamping said auger flights to said auger cylinder includes a first flange supported by one of said frame halves and outwardly of said hollow cylinder and a second flange supported by the other of said frame halves and opposed to said first flange, said first and second flange clampingly engaging an end of one of said auger flights therebetween.

19. An auger for a snowblower, the auger comprising an auger frame having opposite ends and being rotatable about a longitudinal axis, said auger frame including two frame halves secured together and joined at a parting plane including said longitudinal axis, and a pair of auger flights supported by said auger frame, one of said auger flights supported by one end of said auger frame and the other of said pair of auger flights supported by the other end of said auger frame, said auger frame halves including means for clampingly engaging said auger flights for removably securing said auger flights to the said auger frame, said auger frame including a central cylindrical portion having opposite ends, at least one planar impeller flange extending radially outwardly from said central cylindrical portion and intermediate said opposite ends, and wherein said means for clampingly engaging said auger flights includes a first auger flight supporting flange extending radially outwardly from one of said opposite ends of said cylindrical portion and a second auger flight supporting flange supported by said planar impeller flange, said second flange extending transversely to said impeller flange and defining an acute angle with said longitudinal axis.

20. The auger set forth in claim 19 further including an elastomeric member secured to said planar impeller flange and at least a portion of said elastomeric member extending radially outwardly from said impeller flange.

21. An auger for use in a snowblower and comprising an auger body rotatable about a longitudinal axis and including a horizontal auger cylinder having opposite ends and a cylindrical surface, at least a pair of spaced apart auger flights, one of said auger flights supported by one of said ends of said auger cylinder and the other of said auger flights supported by the other of said ends of said cylinder, means for removably clamping said auger flights to said auger cylinder, and an impeller blade removably secured to said auger body for rotation therewith and extending radially from said cylindrical surface, said impeller blade having opposite ends, one of said blade ends being adjacent one of said auger flights and the other of said blade ends being adjacent the other of said auger flights, said auger cylinder including a pair of semi-cylindrical members joined together in facing parallel relationship to form said auger cylinder, said semi-cylindrical members each having opposite ends and longitudinal edges, and a pair of opposed radially outwardly extending impeller flanges extending from said longitudinal edges, said impeller blade being removably clampingly engaged between said impeller flanges.

22. The auger set forth in claim 21 and wherein said means for removably clamping said auger flights to said auger cylinder includes at least one end flange extending from said one longitudinal edge adjacent one of said opposite ends and wherein said auger flights each have opposite ends, one of said flight ends of one of said auger flights supported by said end flange and the other of said flight ends of said one auger flight supported by said impeller flange.

* * * * *